US005207377A

United States Patent [19]

Brecht

[11] Patent Number: 5,207,377

[45] Date of Patent: May 4, 1993

[54] DEFLECTABLE MAILBOX

[76] Inventor: Frederick R. Brecht, 562-A Trenton Ave., Pittsburgh, Pa. 15221

[21] Appl. No.: 894,866

[22] Filed: Jun. 8, 1992

Related U.S. Application Data

[63] Continuation of Ser. No. 749,725, Aug. 26, 1991, abandoned.

[51] Int. Cl.[5] ..... B65D 91/00

[52] U.S. Cl. ..... 232/17; 232/39; 232/51; 232/24; 248/548; 404/10

[58] Field of Search ..... 232/17, 24, 38, 39, 232/47, 51, 52; 40/606, 608, 612; 116/63 R; 248/180, 900, 548, 160; 404/10; 403/2, 50, 51

[56] References Cited

U.S. PATENT DOCUMENTS

| | | | |
|---|---|---|---|
| 792,546 | 6/1905 | Nichols | 232/24 |
| 2,911,174 | 11/1959 | Goss | 248/160 |
| 3,144,985 | 8/1964 | Coyne | 232/24 |
| 3,874,583 | 4/1975 | Moll | 232/17 |
| 3,913,518 | 10/1975 | Kaplan | 40/612 |
| 4,571,118 | 2/1986 | Schmanski | 40/612 |
| 4,737,048 | 4/1988 | Herrstrom | 403/2 |
| 4,759,161 | 7/1988 | Kuzyk | 404/10 |
| 4,915,293 | 4/1990 | Paramski | 232/39 |
| 4,993,626 | 2/1991 | Berry | 234/47 |
| 5,029,783 | 7/1991 | Alvarez | 232/39 |

*Primary Examiner*—Peter M. Cuomo

*Assistant Examiner*—F. Saether

*Attorney, Agent, or Firm*—George C. Atwell

[57] ABSTRACT

A ground-mounted upright mailbox is provided for receiving and storing therein postal material such as letters and variously-sized packages. The mailbox includes a lower mailbox portion which further defines an inner storage compartment, an upper mailbox portion attached to the lower mailbox portion, and a mounting pipe for securing the mailbox into the ground. A laterally deformable lower bellows member is integrally attached to the mailbox subjacent the lower mailbox portion, the lower bellows member allows the mailbox to laterally deflect from its normal upright position when the mailbox is struck by a physical object. Furthermore, the lower bellows member maintains the mailbox in its deflected position until the mailbox is manually righted. In an alternate embodiment, the upright mailbox is secured to the ground by a plurality of mounting pipes. Each mounting pipe includes a flexible, deformable bellows member protruding from one end and which is adapted for attachment to the lower mailbox portion. Each deformable bellows member is adapted to laterally deform when the mailbox is struck by a physical object. After being struck by the object, such as a mail delivery vehicle, the mailbox maintains its deflected position until the mailbox is returned to its normal upright position.

21 Claims, 4 Drawing Sheets

DEFLECTABLE MAILBOX

This is a continuation of application Ser. No. 07/749,725, filed Aug. 26, 1991, in the U.S. Patent and Trademark Office, now abandoned.

BACKGROUND OF THE INVENTION

This invention relates generally to an upright mailbox, and more particularly pertains to an upright mailbox having a bellows member that allows the mailbox to laterally deflect when physically struck by another object and to maintain its deflected position until the mailbox is returned to its normal upright position.

According to a recent survey by the U.S. Postal Service's Delivery Management System, there are an estimated 36 million rural mailboxes in the United States. Mailboxes may be located in a variety of places: at the end of an unpaved driveway obscured by bushes and trees; protruding out from a small embankment to the edge of a narrow two-lane road; unsteadily mounted on a length of upright pipe or wooden framework adjacent the berm of a road; mounted on cinder blocks located at the entrance of a mobile home park; or attached to poles horizontally projecting toward the roadway. Such locations pose manifest hazards to mail delivery personnel and their vehicles.

The delivery of mail occurs year-round in every kind of weather condition. Slick, rain-spattered roads, icy or snow-covered highways, and fog-enshrouded country lanes are just a few of the many weather conditions mail delivery personnel encounter during their rounds. A mail delivery vehicle skidding or sliding into a mailbox unsteadily mounted on an upright length of pipe or a wooden framework or into stacked cinder blocks can be seriously damaged. Moreover, the delivery person inside the vehicle might also be injured. Accidentally colliding with a partially or wholly obscured mailbox may also cause the contents of the mailbox to spill and scatter across the ground; and, if the weather conditions include rain or snow, the contents will be damaged or destroyed.

Given the total number of mailboxes in the United States, both urban and rural, and the potential for accidents, the costs for vehicle damage, replacement of mailboxes, and mail carrier insurance are considerable. Therefore, the U.S. Postal Service has an interest in mailboxes that are designed with some type of breakaway capability. A breakaway capability would permit the mailbox, for example, to break off or deflect and bend away from its normally upright position when struck by a mail delivery vehicle. Other types of breakaway capabilities may include: a mailbox having, or mounted upon, upright springs that deflect laterally when the mailbox is struck and which immediately return, rerighting the mailbox; or a mailbox mounted upon some type of flexible, bendable rubber tubing that partially bends on impact and then immediately returns to its upright position.

There are certain obvious disadvantages with the above-described breakaway capabilities that immediately return the mailbox to its upright position or allow it to break away from its mounting. A breakaway capability that permits the mailbox to break off from its mounting will need to be reattached after the collision. The breakaway capability should be attached so that the mailbox will not break off from slight bumps and glances from vehicles and pedestrians; yet the breakaway capability must also permit the mailbox to break off when struck by vehicles traveling at a certain minimum velocity. It may be difficult to devise a breakaway capability that meets these two requirements.

The breakaway capability that includes a spring or a flexible rubber tubing also has disadvantages. Foremost is the fact that a mailbox mounted upon some type of spring or flexible tubing will immediately bounce back and possibly strike the vehicle. The force of the mailbox rebounding due to the spring or bendable tubing may actually cause the vehicle more damage than the initial collision.

Consequently, there is a need for a mailbox that incorporates some type of breakaway capability into its structure; the breakaway capability being either integral to the structure of the mailbox or attached to the mailbox. Furthermore, the mailbox will require a method of stable ground mounting to prevent the structure from toppling over when struck by a physical object. In addition, a mailbox with a simple, reliable breakaway capability should also have a compartment to store packages and a method to remove the packages stored therein.

Accordingly, it is a primary object of the present invention to provide, for both rural and urban areas, a mailbox having a breakaway capability which allows the mailbox to laterally deflect away from its normally vertical upright position, and to remain in the deflected position after being struck by a physical object such as a mail delivery vehicle. The mailbox would then simply require manual righting in order to return it to its normally vertical upright position. A mailbox with the aforedescribed characteristics will greatly reduce the damage to mail delivery vehicles—and any other type of vehicle—as well as enhance the safety of the passenger or passengers.

SUMMARY OF THE INVENTION

The apparatus of the present invention comprehends an upright deflectable mailbox that includes several different novel structural components that permit the mailbox to laterally deflect away from its normally upright position when struck by a physical object, such as an automobile, truck, or mail delivery vehicle. Moreover, the novel structural components maintain the mailbox in its laterally deflected position until it is returned to its normally upright position.

The upright deflectable mailbox includes an elongated, rectangular-shaped lower mailbox portion having a frontwall, sidewalls, and a backwall, attached to each other along their lateral edges. A rectangular-shaped upper mailbox portion having a front mailbox opening, and an oppositely-disposed upper backwall is attached to the lower mailbox portion. The attached walls of the lower mailbox portion further define an inner storage compartment wherein material such as letters and packages can be deposited.

A mail drop shelf is hingeably attached to the lower mailbox portion and extends into the inner storage compartment. Attached to the mail drop shelf is a mailbox lid which is adapted to pivot in tandem with the mail drop shelf and sealably close the mailbox opening. A lower bellows member is attached subjacent to the lower mailbox portion. The lower bellows member is collapsibly extensible and laterally deformable, and thus allows the mailbox to laterally deflect away from its upright position when struck by a physical object.

Several different embodiments for the mounting means are disclosed for securing the upright mailbox into the ground. In one embodiment, a reinforcing mounting plate is attached to the flat bellows floor. Secured to, and downwardly projecting therefrom, is at least one threaded half-coupling. One end of an elongated mounting pipe is secured to the half-coupling and the other end is secured into the ground or a suitably-sized hole set with concrete.

In a second embodiment, the reinforcing mounting plate is attached to the mounting pipe and extends perpendicularly thereto. Located inside the mounting pipe is a securing nut which is fixed to the reinforcing mounting plate. A threaded bolt is inserted through a plate hole in the reinforcing mounting plate, a floor hole in the flat bellows floor, and into the threaded bore of the securing nut, thus securing the mounting pipe to the upright mailbox.

The apparatus of the present invention also includes an alternate embodiment wherein a flexible mounting means allows the upright mailbox to laterally deflect away from its normal upright position when struck by a physical object, such as a mail delivery vehicle, an automobile, or truck. More specifically, the flexible mounting means includes a plurality of elongated, deformable, flexible bellows members which are adapted to laterally and flexibly deform when the upright mailbox is struck by a physical object. Each flexible bellows member is attached to an upper pipe end of an elongated mounting pipe, and each flexible bellows member has a cylindrical securement end adapted for attachement to the lower mailbox portion of the upright mailbox.

It is an objective of the present invention to provide an upright deflectable mailbox which includes a large interior storage compartment secured against tampering and vandalizing.

It is another objective of the deflectable mailbox of the present invention to provide a pivoting, integrally attached mailbox lid and mail drop shelf which prevents an individual from reaching through the mailbox opening and removing material deposited into the inner storage compartment.

A further objective of the present invention is to provide a deflectable mailbox that can be manufactured in a one-piece construction, preferably through a plastic molding or injection molding process.

Yet another objective of this invention is to provide an upright mailbox that can be easily and quickly mounted into the ground or a layer or bed of cement. In addition, the upright mailbox can be easily disassembled from its mounting for repairs, repainting, or transporting to another location.

It is still another feature of the present invention to provide several different embodiments of a bellows member attached to the mailbox which deform when the upright mailbox is struck by a mail delivery vehicle, thus allowing the mailbox to laterally deflect away from its upright position. Injury to the driver and damage to the vehicle is avoided because the mailbox yields to the force of the moving vehicle and deflects away, instead of remaining firm and rigid as the mailbox receives the force and impact of the vehicle.

Still another feature of the present invention is to provide several different embodiments of the bellows member which prevent the mailbox from immediately returning, in a springing action, to its upright position after being struck. This feature, which will be inherent in the construction of the several embodiments for the bellows member, will prevent injury or damage to the driver or vehicle caused by the force and momentum of a rapidly springing back mailbox.

Various other more detailed objects and advantages, such as arise in connection with carrying out the above ideas in a practical embodiment, will be hereafter illustrated in the accompanying drawings and stated in the following description of the invention.

DETAILED DESCRIPTION OF THE PREFERRED EMBODIMENT

Figure 1:
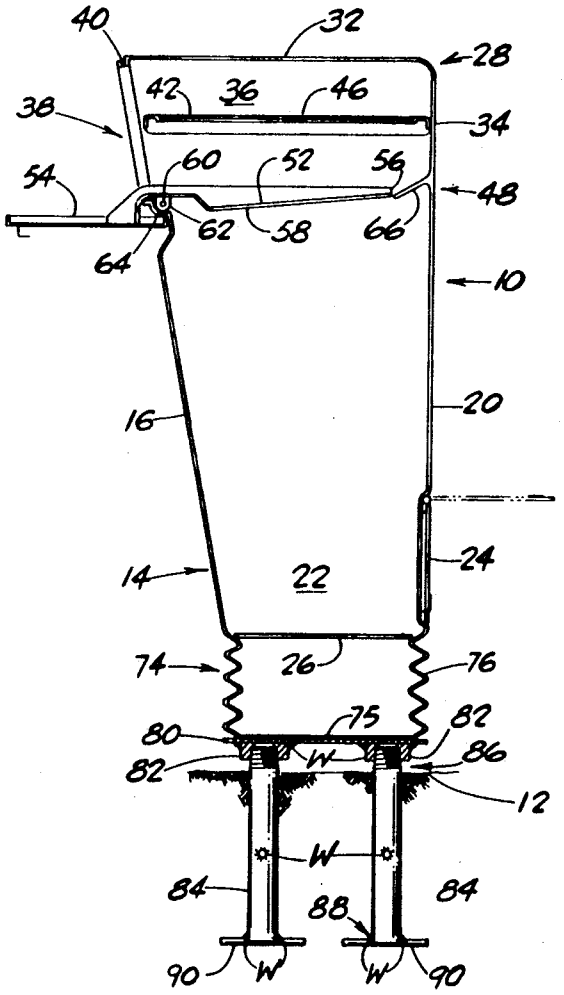
FIG. 1 is a side sectional and elevational view of the preferred embodiment of the apparatus of the present invention.
Figure 2:
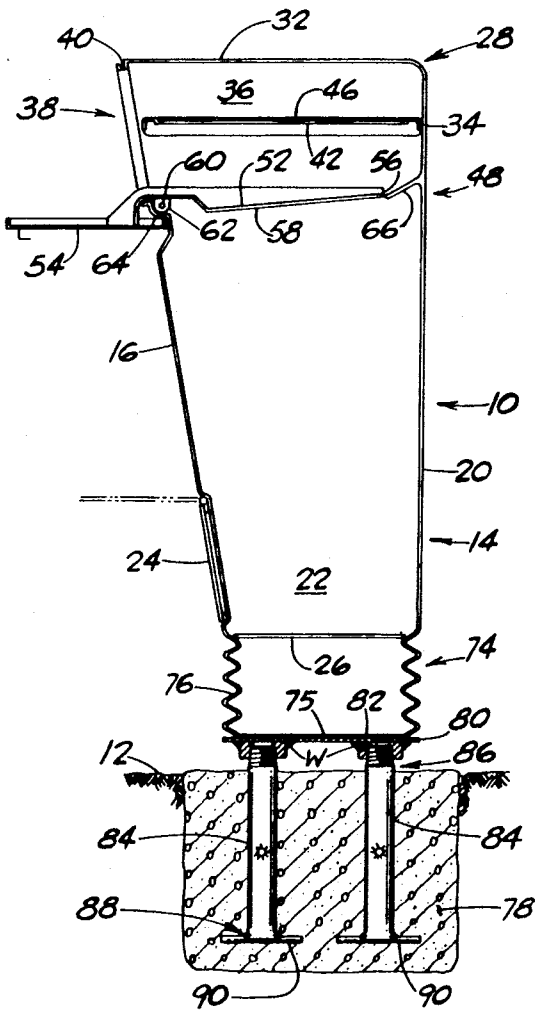
FIG. 2 is a side sectional and elevational view of the apparatus first shown in FIG. 1 showing the mail access door positioned at the front of the mailbox.

Referring to FIGS. 1 and 2, there is illustrated the preferred embodiment of an upright deflectable mailbox 10 for mounting in the ground 12, either in a pre-dug hole which is subsequently filled in (FIG. 1) or in a cement-filled hole (FIG. 2). The mailbox 10 may be mounted anywhere mail delivery and pickup occurs; for example, at the end of a driveway, at the entrance to an apartment complex or mobile home park, or adjacent sidewalks in urban areas. The mailbox 10, as shown in FIGS. 1 and 2, is vertically elongated and generally rectangular-shaped and should be designed and constructed so that the dimensions of the mailbox are in general conformity to U.S. Postal Service regulations.

As illustrated in FIGS. 1 through 4, the mailbox 10 includes a lower mailbox portion 14 which is vertically elongated and substantially rectangular-shaped, and is further defined by an inclined frontwall 16, a pair of oppositely-disposed, vertically upright sidewalls 18, and a vertically-extending backwall 20. All of these structural elements are attached to one another along their respective lateral edges. The frontwall 16, the sidewalls 18, and the backwall 20 define an inner storage compartment 22. The storage compartment 22 is adapted to receive packages, letters, and other mailable material for storage therein and removal therefrom.

The lower mailbox portion 14 also includes a mail access door 24 which is hingeably attached thereto. FIG. 1 illustrates the door 24 hingeably attached to the backwall 20 of the lower mailbox portion 14. The door 24 is adapted to selectively open and close in order to contain material within the storage compartment 22 and to permit removal of material therefrom. The door 24 provides a sealable, watertight closure for the storage compartment 22 and safety from theft. Although not shown in FIGS. 1 through 4, the door 24 should also include a lock to provide security from vandalizing, tampering, and theft. Alternatively, FIG. 2 illustrates the door 24 hingeably attached to the frontwall 16 of the lower mailbox portion 14. The lower mailbox portion 14 also includes a flat, horizontally-extending removably insertable floor member 26 which is placed on the inwardly turned bottom lateral edges of the frontwall 16, the sidewalls 18, and the backwall 20. Packages and other material deposited into the storage compartment 22 rest upon the floor member 26.

Figure 3:
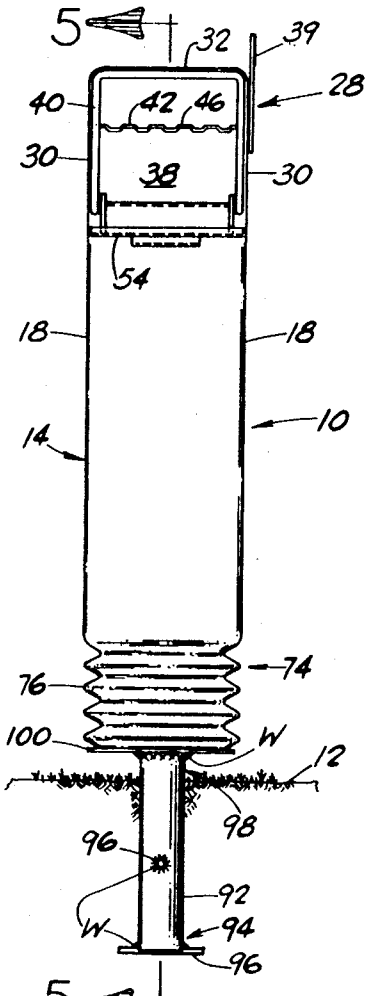
FIG. 3 is a front elevational view of the apparatus first shown in FIG. 1 with the mailbox lid shown in the open position and also illustrating an alternate mounting means.

Projecting upwardly from the lower mailbox portion 14 and attached thereto is a generally rectangular-shaped upper mailbox portion 28. In the apparatus of the present invention, the upper mailbox portion 28 is integrally attached to the lower mailbox portion 14 as part of the plastic molding or injection molding process. The upper mailbox portion 28, as illustrated in FIGS. 1 through 4, includes a pair of oppositely-disposed, vertical sidewalls 30, a flat roof 32, and a backwall 34. The sidewalls 30, the backwall 34, and the roof 32 are joined at their lateral edges to form an enclosed box-like, rectangular-shaped structure with a substantially open interior 36. The upper mailbox portion 28 also includes a mailbox opening 38 which allows material, such as letters and packages, to be passed therethrough for depositing into the storage compartment 22. A flag 39 is pivotally attached to one of the sidewalls 30 of the upper mailbox portion 28, as shown in FIG. 3.

Figure 6:
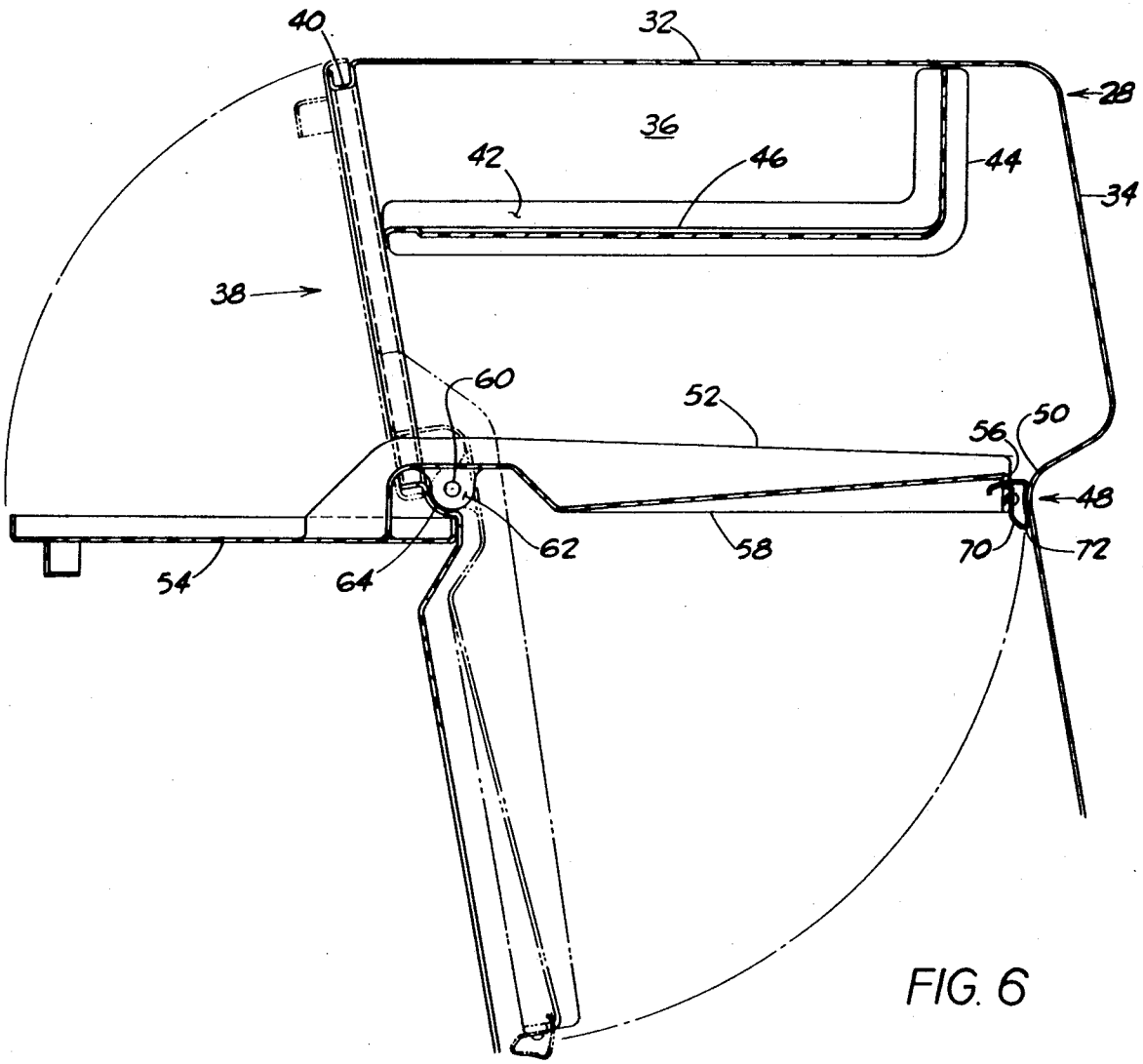
FIG. 6 is an enlarged side elevational view of the apparatus first shown in FIG. 5 illustrating the relative positions of the mailbox lid and mail drop shelf during opening and closing.

Immediately adjacent the opening 38, and located at the most forward edge of each sidewall 30 and the most forward edge of the roof 32, is a trough-like recess or groove 40 which is similar to a rain gutter in structure and function. As illustrated in FIG. 6, the groove 40 extends along the peripheral forward edge of each sidewall 30 and the roof 32. The groove 40 collects rainwater and directs it downward and away from the interior 36 of the upper mailbox portion 28 and also away from storage compartment 22 of the lower mailbox portion 14. The groove 40 thus prevents water from seeping or running into the inside of the mailbox 10 and damaging the contents stored within.

As illustrated in FIGS. 1 and 2, the upper mailbox portion 28 also includes a generally flat, outgoing upper mail shelf 42 whereupon letters and suitably sized packages can be placed for mailing. The shelf 42 is located within the upper mailbox portion 28 and extends substantially the full length within the interior 36 of the upper mailbox portion 28. The shelf 42 is attached to the inside surface of each oppositely-disposed sidewall 30 and the backwall 34. Although not shown in FIGS. 1 through 4, the shelf 42 could be adapted to be removably insertable within the inside of the upper mailbox portion 28. This could be accomplished by employing ledges (not shown) which would be attached or formed to each inside surface of each sidewall 30 and which extend from the backwall 34 to the mailbox opening 38. The shelf 42 could be adapted to be simply placed upon each ledge; or each ledge could have an upwardly opening lengthwise groove formed thereon which would be adapted to mate with a longitudinally-extending downwardly-projecting member (not shown) on the shelf 42. Each respective projecting member would mate with each respective longitudinal groove on each ledge to allow the shelf 42 to be slidably inserted within the upper mailbox portion 28.

Figure 5:
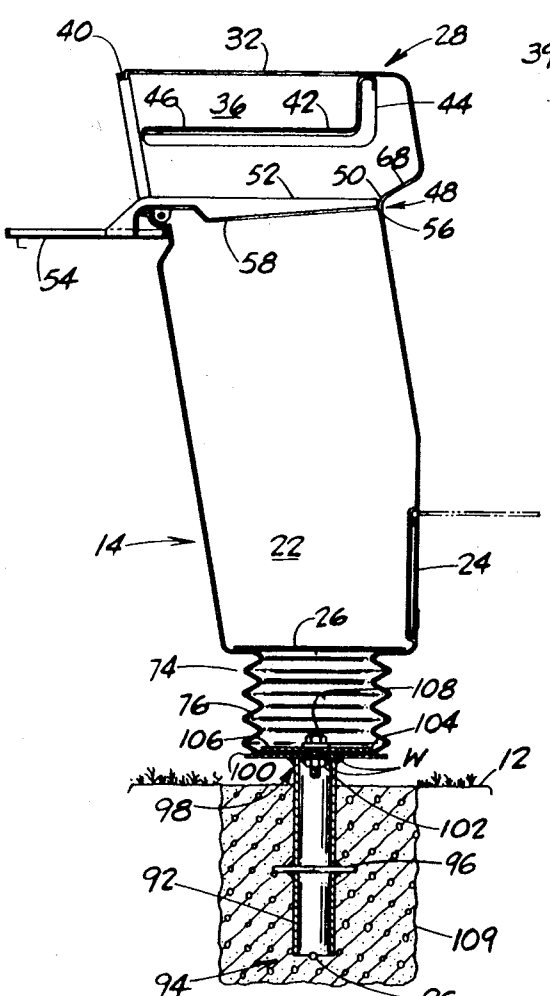
FIG. 5 is a side sectional and elevational view of an alternate embodiment of the apparatus first shown in FIG. 1.

FIGS. 5 and 6 illustrate an alternate embodiment for the upper mail shelf 42. The shelf 42 includes a rearwardly located, vertically-extending member 44 which is integrally attached to the shelf 42 and extends up to the roof 32 of the upper mailbox portion 28. The vertically-extending member 44 is attached to each sidewall 30 and is adapted to block material from reaching the backwall 34 of the upper mailbox portion 28 when the material is placed or tossed onto the shelf 42. While the vertically-extending member 44 shortens the horizontal length of the shelf 42 and thus precludes letters and packages of a length equal to that of the upper mailbox portion 28 from being deposited on the shelf 42, the vertically-extending member 44 also makes removal of material from the shelf 42 easier in that the individual does not have to reach to the backwall 34 of the upper mailbox portion 28 in order to remove the mail or other postal material.

Yet another embodiment for the shelf 42, not shown in any of the figures, is a pivoting upper mail shelf. The pivoting upper mail shelf would include the vertically-extending member 44 and other structural elements as well. Located on the backwall 34 and adjacent the roof 32 of the upper mailbox portion 28 would be a press-in plug which would be removably inserted for press-fitting into a plughole located on the backwall 34. An extension spring having one end attached to the press-in plug and a second end attached to the vertically-extending member 44 would limit the pivoting range of the upper mail shelf. The upper mail shelf in this alternate embodiment would be pivotally attached to each sidewall 30 of the upper mailbox portion 28 at a location where the shelf 42 and the vertically-extending member 44 are joined together. In order to make mail removal easier, the pivoting upper mail shelf would permit the individual to pivot the shelf downward to allow the mail and other material to slide toward the mailbox opening 38. Located on the inside of each sidewall 30 of the upper mailbox portion 28 adjacent the opening 38 and adjacent the roof 32 would be an upraise or protruding stop surface. The stop surface could be an indented ridge, dimple, or other projection which simply prevents the shelf 42 from pivoting all the way up toward the roof 32; thus each stop surface would delimit the upward pivoting motion of the shelf 42.

The shelf 42 of the preferred embodiment of the apparatus as illustrated in FIG. 3 also includes an upper mail surface 46 which has an alternating and longitudinally-extending series of upraised ridges and grooves which run from the backwall 34 to the opening 38. This alternating sequence of upraised ridges and grooves facilitates the removal of any water that may collect on the upper surface 46 of the shelf 42 by providing a means for the water to run off the surface 46.

As shown in FIGS. 5 and 6, an alternate embodiment for the backwall 20 can have the backwall 20 inwardly inclined toward the frontwall 16 so that the uppermost portion 48 of the backwall 20 forms a curved backwall portion 50 that is integrally attached to the lateral edge of the backwall 34 of the upper mailbox portion 28. The purpose of the curved backwall portion 50 will be discussed hereinafter.

As illustrated in FIGS. 1, 2, 5, and 6, the mailbox 10 also includes a substantially flat mail drop shelf 52 which is hingeably attached to each sidewall 18 of the lower mailbox portion 14. In addition, a mailbox lid 54 is integrally attached to the drop shelf 52 thus forming an integrated, one-piece unit. When the lid 54 is opened or closed the drop shelf 52 extends substantially within the storage compartment 22; more specifically, when the lid 54 is fully opened the drop shelf 52 extends substantially horizontally toward the backwall 34 of the upper mailbox portion 28, and when the lid 54 is fully closed the drop shelf 52 extends substantially into the storage compartment 22 downwardly adjacent and generally parallel with the frontwall 16 of the lower mailbox portion 14. The drop shelf 52 is adapted to pivot upward toward the upper mailbox portion 28 and downward into the storage compartment 22, and the integrally attached lid 54 pivots in tandem with the drop shelf 52. The drop shelf 52 also includes a rear edge 56 and a lower shelf surface 58.

The construction of the drop shelf 52 and the lid 54 as a one-piece unit provides an obvious safety feature as shown, for example, in FIGS. 1, 2, 5, and 6. When the lid 54 is fully opened so that letters and packages can be deposited into the storage compartment 22 or removed from the shelf 42, the drop shelf 52 extends substantially and horizontally toward the backwall 34 of the upper mailbox portion 28 so that the drop shelf 52 closes off the storage compartment 22. It is thus impossible for an individual to reach into the storage compartment 22 to remove letters and packages. On the other hand, after the individual has set letters and packages on the drop shelf 52, the lid 54 is pivoted upward to sealably close the opening 38 and the drop shelf 52 pivots downward into the inner storage compartment 22. As the drop shelf 52 pivots downward into the storage compartment 22 the letters and packages slide off the drop shelf 52 and are deposited within the storage compartment 22.

As illustrated in FIG. 6, when fully closed, the lid 54 overlaps the mailbox opening 38 to provide a watertight closure thereof. The groove 40 acts as a rain gutter to drain any water away from the inside of the upper mailbox portion 28 or the storage compartment 22 of the lower mailbox portion 14. Although not shown in any of the figures, both the lid 54 and the drop shelf 52 can include a hollowed out depression. The hollowed out depression on the drop shelf 52 can extend substantially its length and width with a slightly angled slope such that when the drop shelf 52 is in its substantially horizontal position when the lid 54 is fully opened, the depression on the shelf 52 slopes downward and toward the backwall 20 of the lower mailbox portion 14.

As shown in FIGS. 1, 2 and 6, a fastener such as a rivet 60, either of plastic or metal, is pressed into and through each sidewall 30 of the upper mailbox portion 28. A pair of spaced-apart pivoting members 62, one of which is attached to the lower surface 58 of the drop shelf adjacent the frontwall 16 and the lowest portion of each sidewall 30, are adapted to fit onto each rivet 60. Each pivoting member 62 is rounded to conform to a rounded pivoting surface 64 formed at the topmost portion of the frontwall 16 adjacent the opening 38. The curvature of the topmost portion of the frontwall 16 also allows for clearance of the bottom edge of the lid 54 when the lid 54 is opened or closed. The rivets 60 and the pivoting members 62 provide a simple and efficient way to attach the lid 54 and the shelf 52 to the mailbox 10.

The mailbox 10 of the present invention also includes, an shown in FIGS. 1, 2, 5, and 6, a support means for maintaining the shelf 52 in the substantially horizontal position when the lid 54 is opened. The support means is useful if an individual has a bundle of letters or perhaps unwielding packages and wants to keep the lid 54 open until they can be properly placed on the shelf 52; of if an individual wishes to examine mail that is located on the mail shelf 42. The mailbox 10 of the present invention discloses several different kinds of support means.

As shown in FIGS. 1 and 2, the support means includes a support member 66 which is attached at the topmost portion of the backwall 20 of the lower mailbox portion 14, and projects downward into the storage compartment 22. The support member 66 can be formed during the injection molding process employed for the manufacture of the mailbox 10. The support member 66 is adapted to yieldably abut the rear edge 56 of the shelf 52 when the lid 54 is fully opened in order to maintain the horizontal position of the shelf 52. In effect, when the lid 54 is fully opened, the rear edge 56 of the shelf 52 is wedged against and abuts the support member 66 to maintain the shelf 52 in the substantially horizontal position. The support member 66 is preferably constructed from plastic so it will not be unyielding when the rear edge 56 of the shelf 52 abuts the support member 66, nor is the support member 66 of such flexible construction that it is unable to yieldably abut and permit the rear edge 56 of the shelf 52 to wedge against it. The downward inclination of the support member 66 toward the storage compartment 22 causes less stress when the support member 66 yieldably abuts the rear edge 56 than a support member disposed in a substantially horizontal position parallel to the shelf 52.

FIG. 5 illustrates an alternate embodiment of a support means. In this alternate embodiment, the backwall 20, described previously, is upwardly and inwardly inclined toward the frontwall 16 and forms the curved backwall portion 50 which is integrally attached to the upper mailbox portion 28. The curved backwall portion 50 also forms a ledge 68 at the bottom lateral edge of the portion 50 protrudes a sufficient distance into the area intermediate the interior 36 and the storage compartment 22 so that the backwall portion 50 yieldably abuts the rear edge 56 of the shelf 52 when the lid 54 is fully opened in order to maintain the shelf 52 in a substantially horizontal position. The rear edge 56, as shown in FIG. 3, wedges against and abuts the backwall portion 50 when the lid 54 is fully opened.

FIG. 6 illustrates yet another embodiment of the support means. A clip 70 is attached to the rear edge 56 and has a rounded member 72 which is adapted to conform to the curvature of the backwall portion 50. When the lid 54 is fully opened, the clip 70 yieldably abuts the backwall portion 50 and thus the shelf 52 is maintained in a substantially horizontal position. The rounded member 72 is wedged against and abuts the backwall portion 50, and the rounded member 72 slides away from the backwall portion 50 when the lid 54 is closed.

Figure 4:
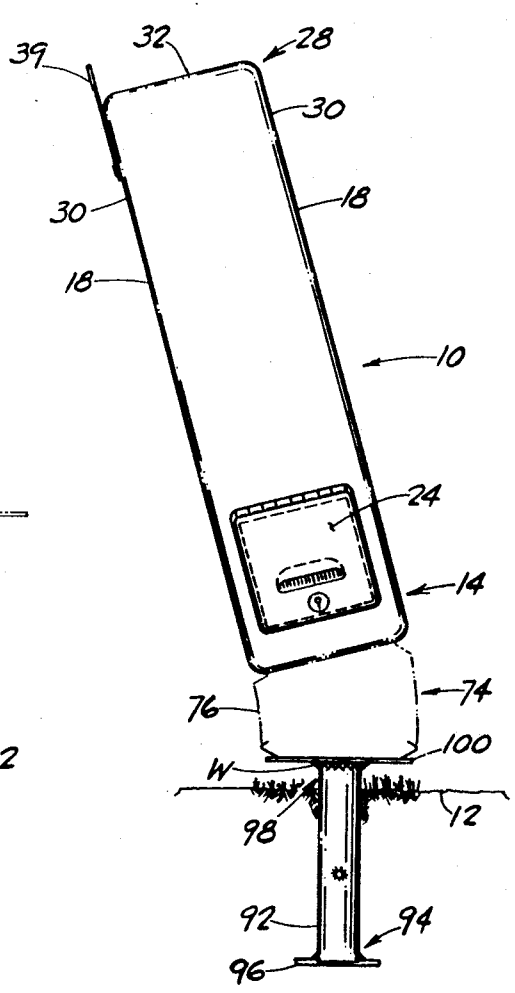
FIG. 4 is a rear elevational view of the apparatus first shown in FIG. 1 with the mailbox shown in a deflected position.

Illustrated in FIGS. 1 through 5 are several embodiments for a primary structural component which is attached subjacent to the lower mailbox portion. As shown in FIGS. 1 and 2, a lower bellows member 74 is integrally attached to the lower mailbox portion 14 and is preferably manufactured during the same injection molding process in which the upper mailbox portion 28 and the lower mailbox portion 14 are manufactured. It follows that the lower bellows member 74 will also be manufactured from a resilient, lightweight, and durable plastic material. The lower bellows member 74 is a vertically elongated structure which, depending on the mounting means to be hereinafter discussed, will be either generally rectangular-shaped, as illustrated in FIGS. 1 and 2, or circular-shaped, as illustrated in FIGS. 3, 4, and 5. The lower bellows member 74 is adapted to be vertically collapsibly extensible and laterally deformable. As shown in FIGS. 1 through 5, the bellows member 74 also has a hollow interior and a flat, horizontally-extending bellows floor 75. The bellows member 74 is capable of laterally deforming throughout a 360° imaginary circle placed concentric to the bellows member 74.

In operation, the bellows member 74 permits the mailbox 10 to laterally deflect away from the striking force of a physical object and toward the ground. The striking force may be a mail delivery vehicle, an automobile, a truck, or an individual. When the mailbox 10 is struck by a physical object, at either the upper mailbox portion 28 or lower mailbox portion 14, the force causes the individual bellows sections 76 on bellows member 74 adjacent the object to extend while the individual bellows sections 76 opposite the striking force will collapsibly deform. Thus, the mailbox 10 will laterally deflect in the direction generally away from the physical object. Depending upon the number of sections 76 included on the bellows member 74, the mailbox 10 may deflect 10°, 20° or as much as 45° away from its normally upright position.

The bellows member 74 is constructed from a plastic material, or glass-fiber-reinforced nylon or graphite composite material, that is durable enough to withstand the sheer stresses that result from those sections 76 being extended when the mailbox 10 is struck by a physical object and the compressive forces that result from the opposite sections 76 collapsibly deforming.

Moreover, after the mailbox 10 is struck and laterally deflects away from the physical object, the mailbox 10 does not spring immediately back to its normally upright position, but, instead, is maintained in its deflected position. This is because the bellows member 74 maintains its laterally deformed position instead of springing back. The bellows member 74 is similar to the deflectable, deformable plastic pipe tubing used in plumbing work. The bellows member 74 possesses some of the same properties as the flexible plastic pipe tubing in that it is capable of bending and deforming but has enough rigidity of construction to prevent it from springing back to its normally vertical upright position.

The ability of the bellows member 74 to maintain a laterally deformed position after the mailbox 10 has been struck also enhances mailbox safety: if the bellows member 74 was designed and adapted to immediately spring back to its normal upright position, the force of the mailbox 10 also returning to its upright position could cause the mailbox 10 to strike the vehicle or its occupant and thus cause injury to the occupant and damage to the vehicle. It should be added that the bellows member 74 could be attached to the lower mailbox portion 14 as a separate part of the injection molding process, but it is preferable that the bellows member 74 be integrally attached to the lower mailbox portion 14 and formed during the same injection molding process in which the upper mailbox portion 28 and the lower mailbox portion 14 are formed.

A number of different mounting means are disclosed to attach and anchor the mailbox 10 into the ground 12, whether it be in a cement-filled hole 78 or directly into the ground 12. As illustrated in FIG. 1, the mounting means adapted for the bellows member 74 includes a horizontally-disposed reinforcing mounting plate 80 positioned underneath and contiguous to the bellows member 74 and is secured thereto. As shown in FIGS. 1 and 2, the mounting plate 80 is attached to the bellows floor 75, possibly by means of an epoxy glue. Welded to the mounting plate 80 and projecting downwardly therefrom is at least one threaded half-coupling; in the preferred embodiment of the present invention, as shown in FIG. 1, a pair of spaced-apart threaded half-couplings 82 are attached by welds, indicated by a "w", to the mounting plate 80 and project downwardly therefrom.

In addition, the mounting means of the preferred embodiment of the mailbox 10 includes at least one elongated mounting pipe; as illustrated in FIG. 1, the preferred embodiment of the mailbox includes a pair of spaced-apart, elongated, preferably steel, mounting pipes 84 having a first pipe end 86 adapted for securement to each respective threaded half-coupling 82 and a second pipe end 88 adapted for securement into the ground 12 or the cement-filled hole 78. At the first pipe end 86 of each respective mounting pipe 84 are located threads which mesh with the threads of each respective threaded half-coupling 82. To add additional stability for the mailbox 10, each mounting pipe 84 includes a pair of reinforcing bars 90. One reinforcing bar 90 is inserted through the respective middle portion of each mounting pipe 84. Another reinforcing bar 90 is secured at the second end 88 of each mounting pipe 84 and extends transverse to the horizontal extension of the middle inserted reinforcing bar 90. The reinforcing bars 90 are especially helpful when placing the mailbox 10 in the hole which then must be filled in. The reinforcing bars 90 add stability as the hole is filled in and help to maintain the mailbox 10 in its upright vertical position.

FIGS. 3, 4 and 5 illustrate an alternate embodiment for the mounting means for the mailbox 10 having the generally circular-shaped bellows member 74. The alternate mounting means includes an elongated, steel mounting pipe 92, a three-inch O.D. pipe being most preferable, having a first pipe end 94 which is adapted for insertion and securement into the ground 12. A pair of elongated reinforcing bars 96 are also used with this mounting pipe 92. One reinforcing bar 96 is attached at the first pipe end 94 and extends transversely on either side of the first pipe end 94; the other reinforcing bar 96 is inserted through the mounting pipe 92, generally through the middle of the pipe 92, and extends transversely on either side of the pipe 92. Attached at a second pipe end 98 of the mounting pipe 92 is a generally circular-shaped reinforcing mounting plate 100 having a centrally-located plate hole (not shown). When the mounting pipe 92 is disposed in its operative position of securement into the ground 12, the plate 100 is perpendicular to the mounting pipe 92. The plate 100 is welded to the pipe 92 at the second end 98 at the places indicated by a "w". Thus, the plate 100 closes off the pipe 92 by being welded to the pipe 92. Secured to the plate 100 by welds that are indicated by the "w" and internally located within the pipe 92 adjacent the second end 98 is a securing nut 102, such as a hexagonal nut. The securing nut 102 also has a threaded bore (not shown) extending therethrough; further, the threaded bore of the securing nut 102 is concentric and axially aligned with the centrally located plate hole of the mounting plate 100. Furthermore, the bellows member 74 also includes a flat, horizontally-extending bellows floor 104 having a centrally located floor hole (not shown) which, when the mailbox 10 is disposed in its operative position, is concentric and axially aligned with the threaded bore of the securing nut 102 and the plate hole of the plate 100.

As illustrated in FIGS. 3 through 5, the plate 100 is positioned subjacent to the floor 104 and is contiguous and parallel to the floor 104. For further reinforcement, a second mounting plate 106, which is flat and generally circular-shaped, can be placed within the bellows member 74 and superjacent to the floor 104. The second plate 106 would also include a second mounting plate hole (not shown) which would be axially aligned with the floor hole of the bellows floor 104, the plate hole of the mounting plate 100, and the threaded bore of the securing nut 102. A securing bolt 108 having a hex head would then be inserted through the second plate hole, the centrally located floor hole, the centrally located plate hole, and into the threaded bore of the nut 102. By tightening the bolt 108, the bellows member 74 will be firmly attached to the plate 100 of the mounting pipe 92 and, since the bellows member 74 is integrally formed to the mailbox 10, the mailbox 10 itself will be firmly attached to the mounting pipe 92.

Securing the mailbox 10 into the ground 12 is relatively easy procedure using either of the two disclosed mounting means. If the mounting means of the mailbox 10 includes the threaded half-couplings 82, the first step would be to dig a hole such as illustrated in FIGS. 1 and 2. Each mounting pipe 84, preferably a two-inch O.D. steel or cast iron pipe, would be insertably threaded into each respective half-coupling 82 and then the bars 90 would be secured thereto. With the pipes 84 threadably secured to the half-couplings 82, the mailbox 10 would be set upright and into the hole with each second end 88 of each pipe 84 placed into the hole, which could then be filled in with dirt or cement.

As shown in FIGS. 1 and 2, only the second ends 88 of the pipes 84 would protrude above the surface of the ground. Thus, the mailbox 10 utilizing this mounting means would be permanently attached to the pipes 84, and the mailbox 10 could not be detached from the pipes 84 without physically destroying or breaking some structural part of the mailbox 10. After the mailbox 10 is permanently secured into the ground 12, the individual would open the mail access door 24 and insert therethrough the floor member 26 for placement on the inwardly turned lateral edges of the frontwall 16, the sidewalls 18, and the backwall 20. The floor member 26 is thus adapted to be removably placeable on the topmost portion of the lower bellows member 74 within the storage compartment 22 itself.

If the mounting means as illustrated in FIGS. 3, 4 and 5 were utilized for the mailbox 10, the first step would be to dig a hole of sufficient depth to contain the pipe 92, preferably a three-inch O.D. steel or cast iron pipe. After the pipe 92 is placed into the hole with only the second end 98 protruding above the hole and the bars 96 secured thereto, the hole is filled in with dirt or with cement 109. When it is determined that the pipe 92 is secure and stabilized in the vertically upright position with the plate 100 spaced above and parallel to the ground 12, the mailbox 10 can be attached in the following manner. First, the floor member 26 should be removed from its normal placement at the topmost portion of the bellows member 74 within storage compartment 22. The mailbox 10 should be placed on the plate 100 so that the bellows floor 104 is contiguous and parallel with the plate 100 and it should be aligned so that the floor hole of the bellows floor 104 is axially aligned with the plate hole of the plate 100 and the threaded bore of the securing nut 102. Although it is not necessary, the second mounting plate 106 can be placed contiguous and superjacent to the floor 104, with the second mounting plate hole axially aligned with the floor hole, the plate hole, and the threaded bore.

The individual can then reach through the mail access door 24 and insert the bolt 108 through the aforementioned second plate hole, floor hole, plate hole, and into the threaded bore of the nut 108. Using a ratchet and an appropriately sized socket, a pair of pliers, or a crescent wrench, for example, the bolt 108 is tightened down upon the bellows floor 104 and the second plate 106. The individual can then place the floor member 26 onto the inwardly turned ledges and, after that is done, the mail access door 24 may be closed and locked and the mailbox 10 is thus firmly secured to the mounting pipe 92 and into the ground 12. The mounting means as illustrated in FIGS. 3, 4, and 5 permit the mailbox 10 to be removably attachable to the pipe 92. If it is necessary to remove the mailbox 10 in order to relocate, repair, or paint the mailbox 10, it is a simple procedure to do so. First, the individual opens the mail access door 24 and reaches into the storage compartment 22 to remove the floor member 26. After the floor member 26 is removed, the individual can loosen the bolt 108. After the bolt 108, is loosened and removed, the mailbox 10 can be simply lifted off the plate 100.

FIGS. 7 through 10 illustrate a second alternate embodiment for mounting the mailbox 10 into the ground 12 and for permitting the mailbox 10 to laterally deflect when struck by a physical object.

More specifically, a flexible mounting means is employed to allow the mailbox 10 to laterally deflect away from its normal upright position when it is struck by a physical object. The lower bellows member 74 of FIGS. 1 through 5 is eliminated, and the flexible mounting means is attached directly to the lower mailbox portion 14, as shall be hereinafter described. As shown in FIGS. 7 through 10, the flexible mounting means includes a plurality of elongated, deformable, collapsibly extensible, generally circular-shaped flexible bellows members 110, each respective bellows member 110 being preferably manufactured from plastic similar in form and construction to the bendable plastic pipe tubing used in general plumbing work and readily available in the marketplace. Each bellows member 110 also includes a cylindrical securement end 112 which is adapted for attachment subjacent and contiguous to a floor plate 114 of the lower mailbox portion 14. Unlike the floor member 26 previously described, the floor plate 114 is permanently and integrally attached to the lower mailbox portion 14 at the bottom lateral edges of the frontwall 16, the sidewalls 18, and the backwall 20.

Each bellows member 110 can be a separate piece or, as shown in FIGS. 7 through 10, each bellows member 110 is integrally attached to a respective mounting pipe. More specifically, the mailbox 10 includes a plurality of elongated, spaced-apart, cylindrical mounting pipes 116. The mounting pipes 116 may be two-inch O.D., PVC, CPVC, steel, or cast iron pipe, although some type of plastic is the preferred material. The bellows members 110 are adapted to laterally and flexibly deform when the mailbox 10 is struck by a physical object and are further adapted to laterally deform regardless of the direction from which the mailbox 10 is struck by the physical object. Each mounting pipe 116 has a lower pipe end 118 adapted for placement into the ground 12 and an upper pipe end 120 which protrudes above the ground 12 adjacent the mailbox 10. Each bellows member 110 is integrally attached to the pipe 116 at the upper pipe end 120 and it is desirable to have each pipe 116 and bellows member 110 manufactured as a one-piece unit. Thus, when each respective pipe 116 and bellows member 110 is disposed in its operative position, both are in concentric vertical alignment.

A preferred method of attaching the mailbox 10 to each respective bellows member 110 and pipe 116 will now be described.

Figure 10:
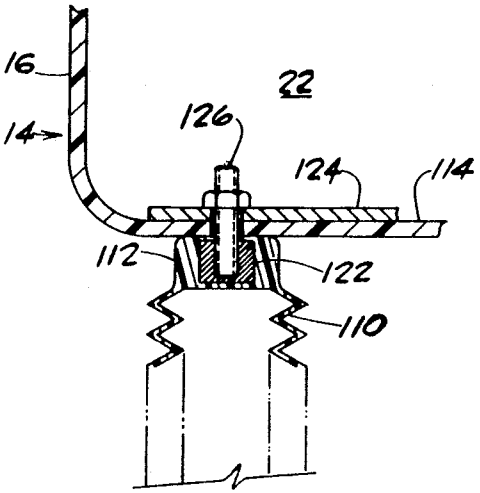
FIG. 10 is an enlarged fragmentary sectional view of the apparatus first shown in FIG. 7.
Figure 7:
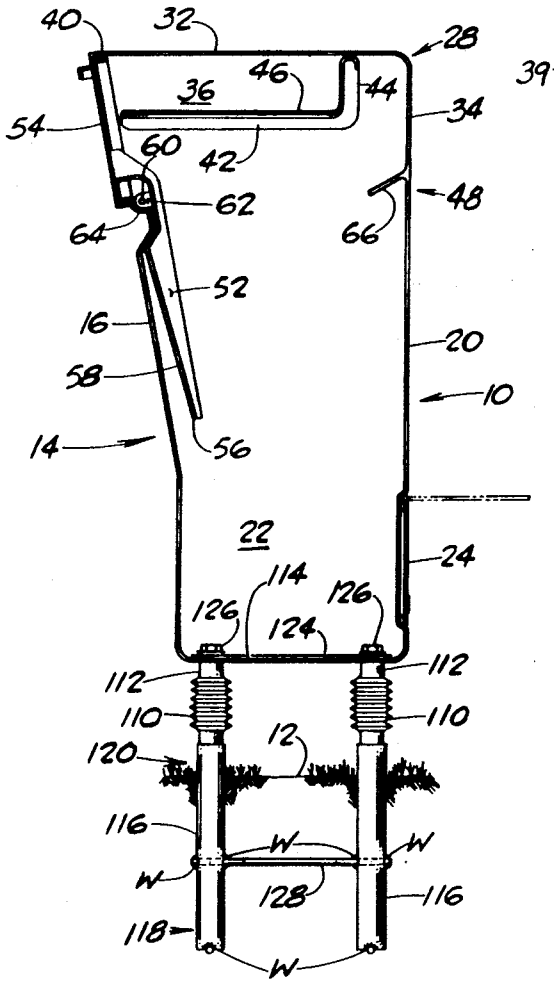
FIG. 7 is a side sectional and elevational view of a second alternate embodiment of the apparatus first shown in FIG. 1.

As illustrated in FIG. 10, located within the securement end 112 of each bellows member 110 and pipe 116 is a threaded stub 122 which is unitized to the securement end 112 of each bellows member 110. Furthermore, each stub 122 is characterized by having a threaded stub bore (not shown) extending substantially therethrough. The floor plate 114 is characterized by having a plurality of spaced-apart floor holes (not shown) which are adapted to be axially aligned with the bore of each stub 122. In addition, as shown in FIGS. 7 and 10, a flat, removably placeable, reinforcing plate 124 may be utilized to add stability and additional strength to the floor plate 114. If the plate 124 is utilized, it would be placed coplanar with, and superjacent to, the floor plate 114. The plate 124 also has a plurality of spaced-apart plate holes (not shown), and when the plate 124 is disposed in its operative position superjacent and coplanar with the floor plate 114, each plate hole is axially aligned with each respective floor hole and also with each bore of each stub 122.

Furthermore, a plurality of elongated rods or bolts 126, such as either standard hex-head cap screws, square-head cap screws, or square-head plain steel machine bolts, are adapted for removable insertion into the bore of each stub 122. When inserted into the bore of each stub 122, each bolt 126 is in concentric alignment with each integrally formed bellows member 110 and pipe 116.

Figure 9:
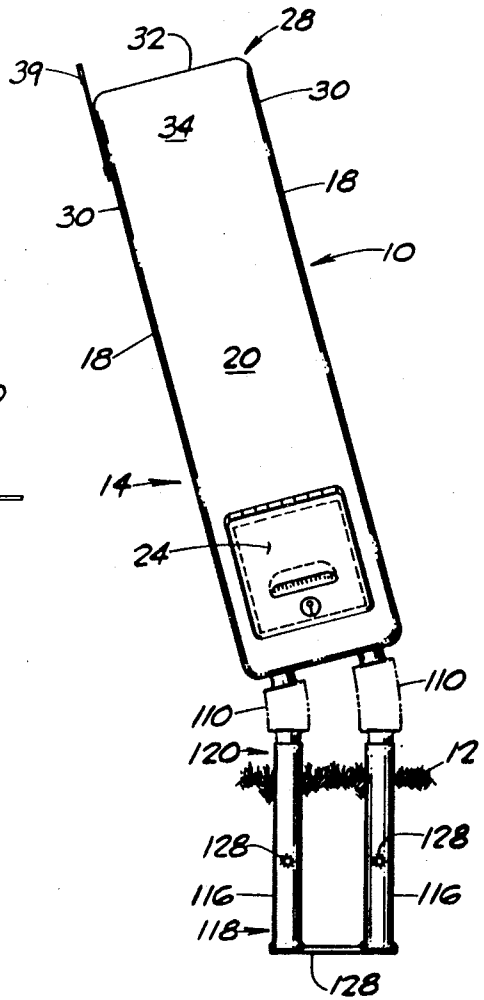
FIG. 9 is a rear elevational view of the apparatus first shown in FIG. 7 illustrating the apparatus in a deflected position.
Figure 8:
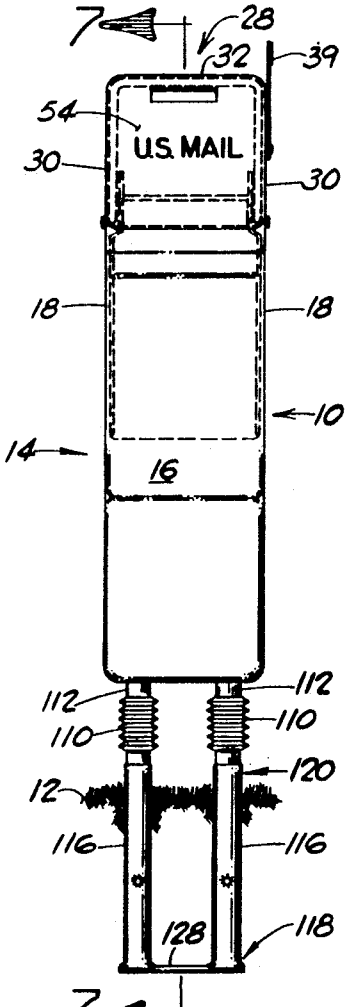
FIG. 8 is a front elevational view of the apparatus first shown in FIG. 7.

It is a relatively easy procedure to mount the mailbox 10, shown in FIGS. 7 through 10, into the ground 12. First, an appropriately sized hole should be dug having sufficient width and depth to accommodate the vertical length of the pipes 116. After the hole is dug, there are two ways that an individual can proceed to mount the mailbox 10. The first way is to place the pipes 116 within the hole so that their distance apart is equal to the spaced distance of the floor holes of the floor plate 114. As shown in FIGS. 7 through 9, a plurality of reinforcing bars 128 are used to provide stability for the pipes 116. One pair of reinforcing bars 128 are attached so as to extend transversely and horizontally from each pipe 116 located in general vertical alignment with the backwall 20 of the lower mailbox portion 14 to the two pipes 116 which are in general vertical alignment with the frontwall 16 of the lower mailbox portion 14. These two reinforcing bars 128 are inserted within the pipes 116 at the midpoint along the vertical length of the pipes 116. In addition, another pair of reinforcing bars 128 extending transverse to the bars 128 inserted at the midpoint of the pipes 116 are also utilized. As illustrated in FIGS. 8 and 9, one bar 128 is attached at each lower pipe end 118 of the pipes 116, which are at the front of the mailbox 10, and another bar 128 is attached at each lower pipe end 118 of the pipes 116, at the rear of the mailbox 10. It should be noted that all of these bars 128 may be adapted for removable attachment to the mounting pipes 116. After the pipes 116 are placed within the hole with the accompanying stabilizing bars 128, the hole is then filled in with either the originally removed dirt or cement.

After the pipes 116 are firmly and rigidly secured, the mailbox 10 can be attached. If desired, the plate 124 can be placed superjacent to the floor plate 114 so that the plate holes and the floor holes are axially aligned. This can be done by passing the plate 124 through the mail access door 24 after the mail access door 24 has been opened as shown in FIG. 7. With each respective plate hole and floor hole axially aligned with the bore of each respective stub 122, one of the bolts 126 can be inserted therethrough and into the stub 122. After inserting each bolt 126 into each respective stub 122, the bolts 126 would protrude upwardly therefrom and into the storage compartment 22 as shown in FIG. 10. However, a plastic round-head, square-head, or hex-head cap (not shown) could be placed on each bolt 126 in order to prevent the bolts 126 from piercing any packages that would be deposited into the storage compartment 22. Each bolt 126 is then tightened down into the bore of each stub 122 and thus the mailbox 10 is attached to the pipes 116. If it is necessary to remove the mailbox 10 for relocation, repairs, or painting, for example, it is a simple matter to open the mail access door 24, reach in, loosen and fully remove each bolt 126 from its insertion into each stub 122. After all the bolts 126 are loosened and fully removed, the mailbox 10 can be simply lifted up off the pipes 116 and movement to another location, repair, or painting can then be performed.

While a preferred embodiment and several embodiments are herein disclosed, it is to be clearly understood that the invention is not to be limited to the exact constructions, mechanisms, and devices illustrated and described because various modifications of these details may be provided in putting the invention into practice.

I claim:

1. An upright mailbox having a lower bellows member which allows the mailbox to laterally deflect when struck by a physical object, the upright mailbox comprising:

a lower mailbox portion having an inclined front wall, a pair of oppositely-disposed, vertically-upright side walls, and a vertically-extending back wall, the lower mailbox portion further defining an inner storage compartment wherein material can be deposited;

a rectangular-shaped upper mailbox portion attached to the lower mailbox portion, the upper mailbox portion having a mailbox opening which allows material to be passed therethrough for depositing into the inner storage compartment;

a generally flat upper mail shelf attached to, and located within, the upper mailbox portion and extending substantially the full horizontal length of the upper mailbox portion;

a substantially flat mail drop shelf hingeably attached to the side walls adjacent the mailbox opening and extending substantially within the inner storage compartment, the mail drop shelf adapted to pivot upward toward the upper mailbox portion and downward into the inner storage compartment;

a mailbox lid attached to the mail drop shelf for pivoting in tandem therewith, the mailbox lid adapted for sealably closing the mailbox opening;

a collapsibly-extensible, laterally deformable lower bellows member attached subjacent to the lower mailbox portion and adapted to laterally deform when the upright mailbox is struck by a physical object, the lower bellows member adapted to maintain the laterally deflected position of the mailbox until the mailbox is returned to an upright position by an external force;

a mail access door hingeably attached to the back wall of the lower mailbox portion and adapted to selectively open and close in order to contain material within the inner storage compartment and permit removal of material therefrom; and a mounting means for securing the upright mailbox into the ground, the mounting means located beneath the lower bellows member and attached thereto.

2. The apparatus of claim 1 where the lower bellows member is generally rectangular-shaped and is integrally attached subjacent to the lower mailbox portion.

3. The apparatus of claim 1 where the lower bellows member is generally circular-shaped and is integrally attached subjacent to the lower mailbox portion.

4. The apparatus of claim 1 where the lower bellows member includes a flat, horizontally-extending bellows floor.

5. The apparatus of claim 4 wherein the mounting means includes a horizontally disposed reinforcing mounting plate positioned underneath and contiguous to the bellows floor and which is secured thereto.

6. The apparatus of claim 5 wherein the mounting means includes at least one threaded half-coupling secured to the reinforcing mounting plate and downwardly projecting therefrom.

7. The apparatus of claim 6 wherein the threaded half-coupling is secured to the bellows floor and downwardly projects therefrom.

8. The apparatus of claim 7 wherein the mounting means includes at least one elongated mounting pipe, the mounting pipe having a first pipe end adapted for securement to the half-coupling and a second pipe end for securement into the ground.

9. The apparatus of claim 1 further comprising a mail access door hingeably attached to the frontwall of the lower mailbox portion and adapted to selectively open and close in order to contain material within the inner storage compartment and permit removal of material therefrom.

10. The apparatus of claim 1 wherein the mail drop shelf includes an upper mail surface for receiving material thereon, a lower shelf surface, and a rear edge.

11. The apparatus of claim 10 further comprising support means for maintaining the mail drop shelf in a substantially horizontal position when the mailbox lid is opened.

12. The apparatus of claim 11 wherein the support means includes a support member attached to the backwall and projecting into the inner storage compartment, the support member adapted to yieldably abut the rear edge of the mail drop shelf when the mailbox lid is fully opened in order to maintain the horizontal position of the mail drop shelf.

13. The apparatus of claim 12 wherein the backwall is inwardly inclined toward the frontwall and forms a curved backwall portion that is integrally attached to the upper mailbox portion.

14. The apparatus of claim 13 wherein the curved backwall portion is adapted to yieldably abut the rear edge of the mail drop shelf when the mailbox lid is fully opened in order to maintain the horizontal position of the mail drop shelf.

15. The apparatus of claim 14 further comprising a clip attached to the rear edge of the mail drop shelf, the clip adapted to yieldably abut the curved backwall portion when the mailbox lid is fully opened so that the mail drop shelf will be maintained in a horizontal position.

16. The apparatus of claim 1 wherein the upper mail shelf has a rearwardly located, vertically-extending member integrally attached to the upper mail shelf, the vertically-extending member also attached to the upper mailbox portion sides and adapted to block material from reaching the back of the upper mailbox portion.

17. An upright mailbox having a means which allows the mailbox to laterally deflect when struck by a physical object, the upright mailbox comprising:

a lower mailbox portion having an inclined front wall, a pair of oppositely-disposed, vertically-upright side walls, and a vertically-extending back wall, the lower mailbox portion further defining an inner storage compartment wherein material can be deposited;

a rectangular-shaped upper mailbox portion attached to the lower mailbox portion, the upper mailbox portion having a mailbox opening which allows materials to be passed therethrough for depositing into the inner storage compartment;

a generally flat upper mail shelf attached to, and located within, the upper mailbox portion and extending substantially the full horizontal length of the upper mailbox portion;

a substantially flat mail drop shelf hingeably attached to the side walls adjacent the mailbox opening and extending substantially within the inner storage compartment, the mail drop shelf adapted to pivot upward toward the upper mailbox portion and downward into the inner storage compartment;

a mailbox lid attached to the mail drop shelf for pivoting in tandem therewith, the mailbox lid adapted for sealably closing the mailbox opening;

a mail access door hingeably attached to the back wall of the lower mailbox portion and adapted to selectively open and close in order to contain material within the inner storage compartment and permit removal of material therefrom; and a flexible mounting means for securing the upright mailbox into the ground so that the upright mailbox will laterally deflect when struck by a physical object and maintain its deflected state until physically returned to the upright position, wherein the flexible mounting means includes a plurality of elongated mounting pipes, each mounting pipe having a lower pipe end for placement into the ground and a upper pipe end protruding above the ground for attachment to the upright mailbox and, a plurality of elongated, deformable, generally circular-shaped flexible bellows members, each bellows member attached to the upper pipe end of each mounting pipe, wherein the flexible bellows members facilitate the deflection when the mailbox is struck by the physical object.

18. The apparatus of claim 17 wherein each flexible bellows member includes a cylindrical securement end adapted for attachment subjacent and contiguous to the lower mailbox portion.

19. The apparatus of claim 18 wherein each respective mounting pipe and attached flexible bellows member are in concentric alignment when disposed in their operative position.

20. The apparatus of claim 19 wherein a stub is located within the securement end of each flexible bellows member and is attached thereto, each stub further characterized by having a stub bore extending substantially therethrough.

21. The apparatus of claim 20 further comprising a plurality of vertically-extending, elongated rods adapted for insertion into the bore of each respective stub and protruding upwardly therefrom and into the inner storage compartment, each rod being in concentric alignment with each respective flexible bellows member and mounting pipe.

* * * * *